US005371720A

United States Patent [19]

Cuomo

[11] Patent Number: 5,371,720

[45] Date of Patent: Dec. 6, 1994

[54] OPTICAL FIBER PRESSURE SENSOR FOR LIQUID LEVEL MONITORING

[75] Inventor: Frank W. Cuomo, East Providence, R.I.

[73] Assignee: The United States of America as represented by the Secretary of the Navy, Washington, D.C.

[21] Appl. No.: 199,868

[22] Filed: Feb. 22, 1994

[51] Int. Cl.[5] ..... H04R 23/00

[52] U.S. Cl. ..... 367/149; 367/908; 73/715; 356/345; 340/619

[58] Field of Search ..... 367/149, 908; 356/345, 356/358; 73/715; 340/614, 618, 619

[56] References Cited

U.S. PATENT DOCUMENTS 4,599,711 7/1986 Cuomo ..... 367/141
4,745,293 5/1988 Christensen ..... 250/577
5,072,617 12/1991 Weiss ..... 73/299
5,247,490 9/1993 Goepel et al. ..... 367/149
5,257,090 10/1993 Meinzer et al. ..... 356/358

*Primary Examiner*—J. Woodrow Eldred
*Attorney, Agent, or Firm*—Michael J. McGowan; Prithvi C. Lall; Michael F. Oglo

[57] ABSTRACT

An apparatus for continuously monitoring changes in a liquid level in accordance with a differential pressure is provided. A sensor body immersed in the liquid supports two thin-filmed metallic diaphragms that are independently, axially responsive to pressure of the liquid. Each diaphragm has a different modulus of elasticity. Two fiber optic pressure sensors are mounted within an air space encased by the sensor body in combination with the two diaphragms. Each of the two fiber optic pressure sensors detects the axial response of one of the two diaphragms. The displacement difference between the two diaphragms is an indication of differential pressure related to the liquid level.

12 Claims, 3 Drawing Sheets

OPTICAL FIBER PRESSURE SENSOR FOR LIQUID LEVEL MONITORING

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to monitoring the level of a liquid and more particularly to an apparatus for monitoring the liquid level by measuring differential pressure thereof.

(2) Description of the Prior Art

Transmitters intended for liquid level monitoring have been manufactured for years. A variety of designs, ranging from electronic to pneumatic arrangements, have been used. Electronic differential pressure cell transmitters are designed to measure differential pressures within an enclosure. Although these devices have accurate high pressure range capabilities, they are limited by their large size and are capable of monitoring liquid levels only on the order of inches of the liquid column, and require electrical power at the detector location. These prior art limitations greatly inhibit the use of such devices by the chemical or nuclear industries, and in the medical field where liquid level monitoring on a much smaller scale is required. Furthermore, in many applications, it is not feasible or safe to have electric power in the vicinity of the level detector.

With the advent of optical fiber technology and the subsequent numerous applications to optical fiber sensors, several designs have been proposed for liquid level measurement. Some of the salient considerations over the previous art include better sensitivity, design versatility, and freedom from electromagnetic interference. To date, optical fiber liquid level sensors have typically been limited to switches, indicating the presence of a liquid, and not to devices for measuring a continuous range of liquid levels.

SUMMARY OF THE INVENTION

Accordingly, it is an object of the present invention to provide an apparatus for continuous monitoring small changes in liquid levels accurately.

It is a further object of the present invention to provide an apparatus for continuous monitoring of a liquid level that experiences small changes.

A still further object of the present invention is to provide an apparatus for continuous monitoring of a liquid level that is a passive device requiring no electrical power at its detector end.

Other objects and advantages of the present invention will become more obvious hereinafter in the specification and the accompanying drawings.

In accordance with the present invention, an apparatus is provided for the continuous monitoring of small liquid level changes based on differential pressure of the liquid. A sensor body is immersed in a liquid which has two diaphragms affixed thereto such that each diaphragm can independently respond to the pressure of the liquid. Response of the diaphragms to the pressure is in the form of an axial deflection of the diaphragm. Each diaphragm generates a different pressure response based on diaphragm dimensions, materials and/or placement. The sensor body along with the two diaphragms encloses an air space. Two optical pressure sensors, of identical design, are provided within the air space for measuring the deflection of each diaphragm. Different deflection measurements owing to the different diaphragm dimensions, materials and/or placement result in a differential pressure measurement related to the liquid level.

DESCRIPTION OF THE PREFERRED EMBODIMENT

Figure 1:
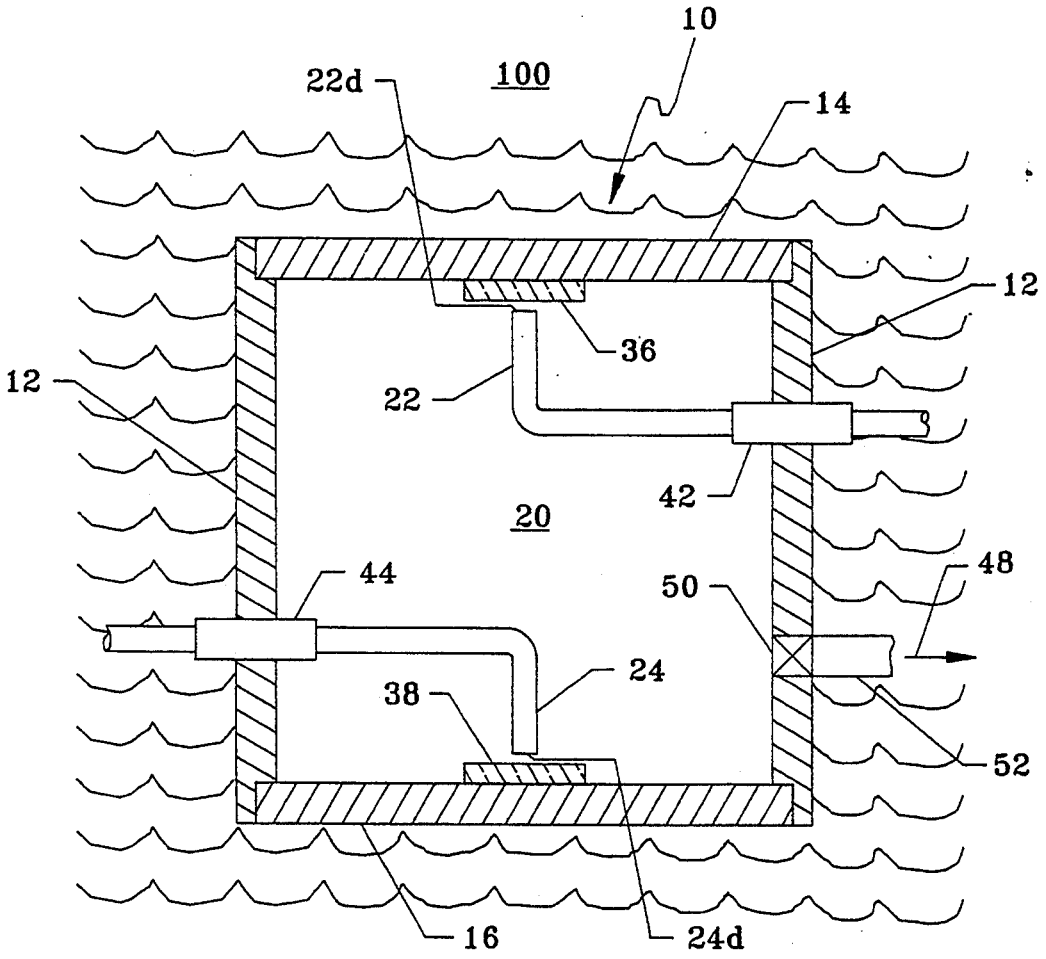
FIG. 1 is a cross-sectional view of a liquid level monitoring apparatus illustrating an embodiment of the present invention.

Referring now to the drawings, and in particular to FIG. 1, there is shown one embodiment of the liquid level monitoring apparatus 10 according to the teachings of the present invention. Sensor body 12, shown partly in cross-section, is immersed in a liquid 100 under test for monitoring its level. Body 12 has two diaphragms, 14 and 16 affixed thereto so as to encase an air space 20. While diaphragms 14 and 16 are shown in an opposed top and bottom relationship with respect to the surface of liquid 100, the invention is not so limited. Indeed, diaphragms 14 and 16 may both be mounted side by side or placed at each side of the sensor body 12. The only requirement is that diaphragms 14 and 16 be able to independently generate a different pressure response due to the liquid under test.

Diaphragms 14 and 16 are chosen, and fixed to body 12, to axially deflect them in response to the pressure of the liquid 100. The pressure changes, affect the deflection of the diaphragms. In order to generate a differential pressure with the single apparatus 10 of the present invention, diaphragms 14 and 16 must each generate a different deflection at their centers for an equal applied pressure. This may be achieved in a variety of ways. For example, diaphragms 14 and 16 may be constructed from the same material as long as they are of different thicknesses or have different surface areas. Alternatively, diaphragms 14 and 16 may be constructed of different materials of equal thickness and surface area. In yet another embodiment, diaphragms 14 and 16 are identical in material and dimensions, thereby making placement of diaphragms 14 and 16 the variable parameter causing the differential pressure. Of course, any combination of the above will work as well.

Figure 2A:
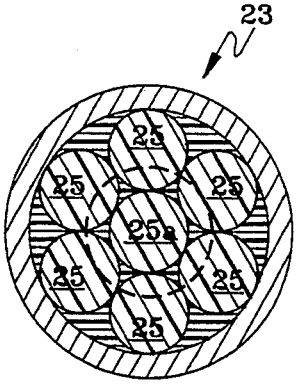
FIG. 2*a* and 2*b* are cross-sectional views of the optical fiber sensors used to measure the axial deflection of the diaphragms.
Figure 2B:
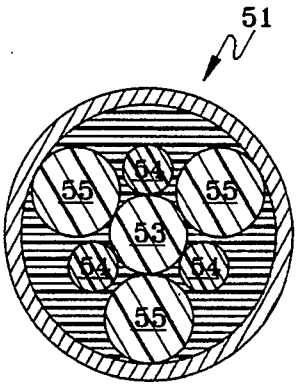
Figure 3:
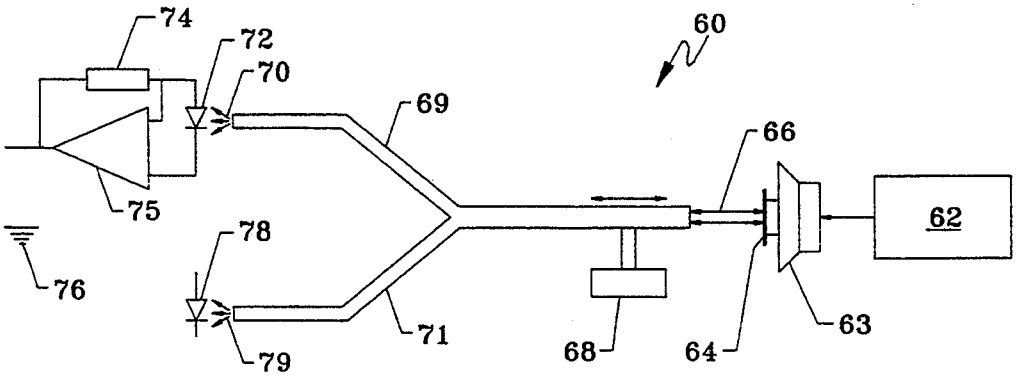
FIG. 3 is a diagrammatic representation of a multilever miniature fiber optic transducer used to measure the axial displacement of the diaphragms.

Mounted within the air space 20 are two pressure sensors 22 and 24 of identical design, for respectively measuring the deflections of diaphragms 14 and 16 which have respective reflectors 36 and 38 attached thereto. For purposes of describing the preferred embodiment, sensors 22 and 24 are optical fiber pressure sensors having their respective distal ends 22*d* and 24*d*, located parallel to and a small distance away from diaphragms 14 and 16 respectively. Two types of optical fiber sensors 23 and 51 that may be employed are shown in FIG. 2*a* and FIG. 2*b* wherein each of outer cylindrical metallic tubes includes preferably seven optical fibers for illustration purposes only and not as a limitation. In FIG. 2*a* the optical fibers which is designated by 25*a* is a transmit fiber and the other six fibers, each designated as 25 act as receiving optical fibers. The seven fibers are potted in the cylindrical tube using an epoxy. Optical fiber sensor 51 is shown in FIG. 2*b* and has a central transmit fiber 53 surrounded by three receive optical fibers 54 of equal radius and the other three receive optical fibers 55 of another equal but different radius. The pressure sensors can have varying configurations as taught in my U.S. Pat. No. 4,599,711 which is incorporated herein by reference. A typical multi-lever miniature fiber optical transducer 60 is shown diagrammatically in FIG. 3 which uses a signal generator 62, a loud speaker 63, a mirror 64 experiencing deflection 66, a translational device 68, optical fibers 69 and 71 and associated electronics including photodiode 72, LED 78, a resistor 74, operational amplifier 75 with ground connection 76. Alternatively, optical fiber pressure sensors 22 and 24 may be replaced with grating pressure sensors comprised of square wave Ronchi gratings.

In order to prevent liquid 100 from leaking into air space 20, optical fiber pressure sensors 22 and 24 pass through sensor body 12 via airtight sleeves 42 and 44, respectively. Optical fiber pressure sensors 22 and 24 receive light from a light source (not shown) and return light to measuring equipment (not shown) typically located outside the liquid being monitored. As is readily apparent, the use of optical fiber pressure sensors 22 and 24 and light in the present invention requires no electrical power near the liquid. This is of great benefit when safety is a concern due to the volatility of the liquid 100.

To allow diaphragms 14 and 16 to move freely in response to the pressure of the liquid, the air space 20 is maintained at a constant static pressure. One method of achieving this is to vent air space 20 to atmospheric pressure, indicated generally by arrow 48, via a valve 50 installed in the sensor body 12. Typically, valve 50 is a conventional bleeder valve. Valve 50 vents to the atmosphere via the outlet 52.

It is also to be noted that each of the diaphragms 14 and 16 has a corresponding light reflector 36 and 38 attached thereto for measuring the deflection of the diaphragms.

While the shape of diaphragms 14 and 16 is not critical with respect to the present invention, they are typically circular plates. Since the greatest amount of deflection of a circular plate diaphragm is at its center, optical fiber pressure sensors 22 and 24 are typically located accordingly. Materials used to construct diaphragms 14 and 16 may vary from metals to some other material having the proper stiffness to yield a response over a wide pressure range. Therefore, in order to better understand the great utility of the present invention, an example of the preferred embodiment shown in FIG. 1 will now be described.

Figure 4:
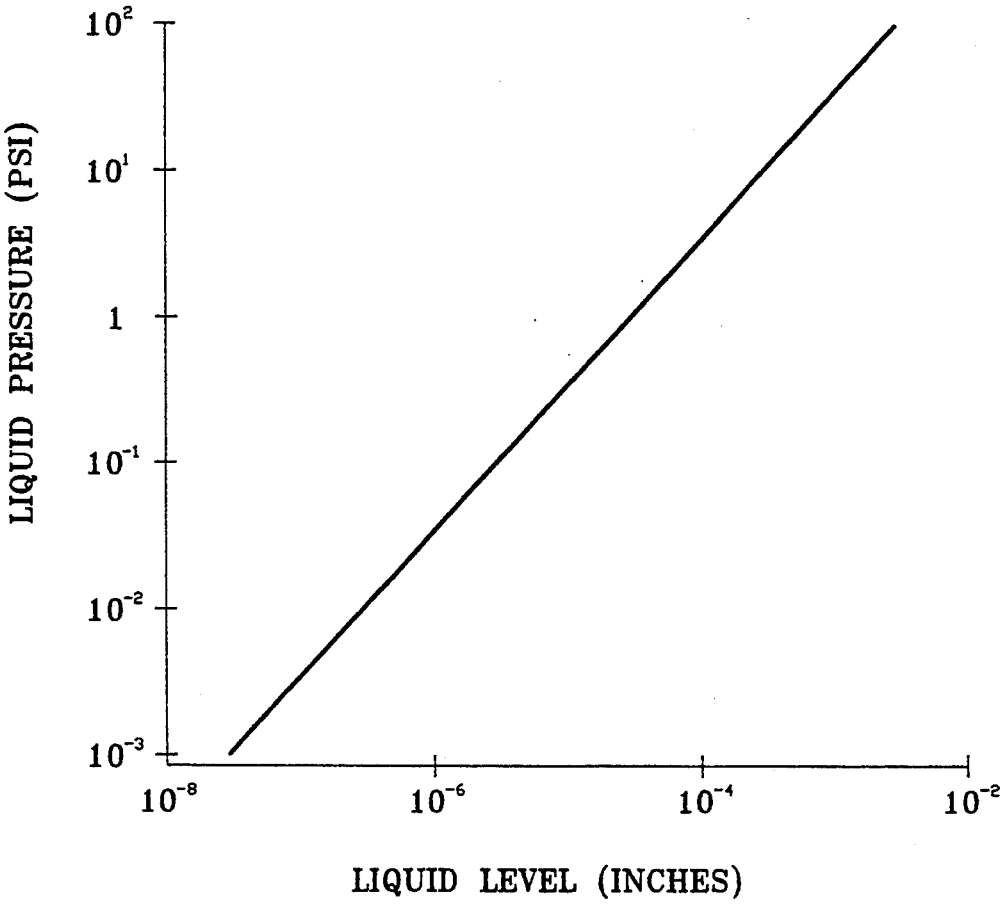
FIG. 4 is a graph of the liquid differential pressure and the level displacement thereof as exhibited by the monitoring apparatus of the present invention.

Diaphragms 14 and 16 were constructed of monel. Each diaphragm had a diameter of 0.75 inches while one diaphragm was 0.015 inches thick and the other diaphragm was 0.022 inches thick. Diaphragms having these dimensions have a deflection displacement range of approximately $10^{-9}$ to $10^{-4}$ meters according to deflection and plate stiffness equations taught by C. M. Harris and C. E. Crede in the "Shock and Vibration Handbook", McGraw Hill Book Company, Inc, 1961. This displacement range is based on a dynamic range of 100 decibels which is equivalent to a pressure range of $10^{-3}$ to 100 per square inch (psi). By being able to measure pressures as low as $10^{-3}$ psi, the present invention is sensitive to changes in liquid level on the order of 0.7 mm. The difference in deflection or displacement of diaphragms 14 and 16 is shown graphically in FIG. 4. As is apparent, a linear relationship exists between liquid level and pressure of the liquid. The linearity of the relationship extends over a wide range of pressures from $10^{-3}$ to 100 PSI. It is seen differential pressure is directly related to the liquid level.

The advantages of the present invention are numerous. A single package, differential pressure apparatus is provided to monitor small changes in liquid level. No electric power is needed near the liquid thereby making the device safe for use in all liquids. Use of fiber optic pressure sensors also allows the apparatus to be sensitive to minute changes in liquid level. The present invention is also efficient since all light energy is conserved within the fiber optic sensors. Finally, all of the above advantages may be achieved in a variety of configurations.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An apparatus for continuously monitoring changes in a liquid level in accordance with a differential pressure, comprising:

a sensor body immersed in said liquid;

a first diaphragm, fixed to said sensor body wherein said first diaphragm experiences deflection in response to pressure of the liquid, said first diaphragm further having a first set of design parameters;

a second diaphragm, fixed to said sensor body wherein said second diaphragm experiences deflection in response to the pressure of the liquid, said second diaphragm further having a second set of design parameters different from said first set of design parameters wherein the deflections of said first and second diaphragms are based on said first and second set of design parameters, respectively, and wherein said sensor body along with said first and second diaphragms encloses an air space having a constant static pressure; and means, mounted within the air space, for independently measuring the deflections of said first and said second diaphragms wherein a difference between said measured deflections is a measure of the differential pressure related to the liquid level.

2. An apparatus as in claim 1 further comprising means for maintaining the air space within said sensor body at the constant static pressure.

3. An apparatus as in claim 2 wherein said constant static pressure means includes a bleeder valve mounted in said sensor body connecting the air space to atmospheric pressure whereby the air space is maintained at atmospheric pressure regardless of the deflections of said first and said second diaphragms.

4. An apparatus as in claim 1 wherein said independent measuring means comprises first and second pressure sensors of identical design for measuring the deflections of said first and second diaphragms, respectively, said first and second pressure sensors being spaced apart from said first and second metal diaphragms, respectively, by a sensor-diaphragm gap.

5. An apparatus as in claim 4 wherein said first and second pressure sensors are multi-lever, miniature fiber optic transducers.

6. An apparatus as in claim 4 wherein said first and second pressure sensors are grating pressure sensors.

7. An apparatus as in claim 1 wherein said first and second set of design parameters include type of material, dimensions and placement in said sensor body.

8. An apparatus for continuously monitoring changes in a liquid level in accordance with a differential pressure, comprising:

a sensor body immersed in a liquid, said sensor body encasing an air space;

first and second thin-film metallic diaphragms independently mounted in said sensor body, exposed on one side to the air space and on the other side to the liquid wherein said diaphragms are axially responsive to pressure of the liquid, said first and second diaphragms each generating a different axial response wherein said first and second diaphragms are axially responsive to pressures in the range of $10^{-3}$ to 100 PSI;

first and second fiber optic pressure sensors passing through said sensor body and disposed within the air space for measuring the axial response of said first and second diaphragms, respectively, said first and second sensors each having a distal end parallel to said first and second diaphragms, respectively; and means for continually maintaining the air space at a constant static pressure whereby the axial response of said first and second diaphragms as measured by said first and second pressure sensors, respectively, is indicative of the differential pressure related to the liquid level.

9. An apparatus as in claim 8 wherein both said first and second thin-film metallic diaphragms comprise circular plate diaphragms.

10. An apparatus as in claim 8 wherein said means for continually maintaining the air space at a constant static pressure comprises means for venting the air space to atmospheric pressure.

11. An apparatus as in claim 9 wherein the distal end of said first and second sensors is aligned with the center of said first and second diaphragms.

12. An apparatus as in claim 8 wherein said first and second sensors are multi-lever, miniature fiber optic transducers.

* * * * *